US006123039A

United States Patent [19]

Niino

[11] Patent Number: 6,123,039

[45] Date of Patent: Sep. 26, 2000

[54] ENDLESS-BELT TYPE WALKING PRESSER FOOT

[75] Inventor: Kumao Niino, Ota-ku, Japan

[73] Assignee: Yugen Kaisha Niiken Kogyosho, Tokyo, Japan

[21] Appl. No.: 09/455,694

[22] Filed: Dec. 7, 1999

[51] Int. Cl.[7] ..... D05B 29/06

[52] U.S. Cl. ..... 112/235

[58] Field of Search ..... 112/235, 320, 112/322, 304; 474/159, 174, 175, 205, 246; 198/617, 951

[56] References Cited

U.S. PATENT DOCUMENTS

| | | | |
|---|---|---|---|
| 4,462,530 | 7/1984 | Block et al. | 112/322 X |
| 4,719,864 | 1/1988 | Barrett et al. | 112/304 X |
| 5,006,096 | 4/1991 | Breher | 474/205 X |
| 5,013,286 | 5/1991 | Breher | 474/205 |
| 5,383,418 | 1/1995 | Block et al. | 112/235 X |
| 5,410,975 | 5/1995 | Dudek et al. | 112/304 X |

FOREIGN PATENT DOCUMENTS

| | | | |
|---|---|---|---|
| 1068536 | 11/1959 | Germany | 112/214 |
| 1-111577 | 7/1989 | Japan . | |
| 8-155168 | 6/1996 | Japan . | |

*Primary Examiner*—Ismael Izaguirre

*Attorney, Agent, or Firm*—Frishauf, Holtz, Goodman, Langer & Chick, P.C.

[57] ABSTRACT

An endless belt-type walking presser foot is provided, which is capable of preventing slippage of cloth during superimposed seaming. A frame member has a pair of first endless belt guide grooves formed in a bottom surface thereof at locations near lateral side edges of the bottom surface and extending in a longitudinal direction of the presser foot. A pair of roller supports are provided in front and rear portions of the frame member. A plurality of rollers are each journaled to a corresponding one of the roller supports and each have a second endless-belt guide groove in the form of an annulus formed therein. A pair of endless belts each have a train of guide projections formed on an inner peripheral surface thereof and fitted in a corresponding one of the first endless belt guide grooves and a corresponding one of the second endless belt guide grooves, and a train of cloth slippage preventing projections are formed on an outer peripheral surface thereof. The inner peripheral surface of each of the endless belts has a train of small projections formed thereon which are configured so as to be in point or line contact with the bottom surface of the frame member and the roller.

7 Claims, 8 Drawing Sheets

ENDLESS-BELT TYPE WALKING PRESSER FOOT

BACKGROUND OF THE INVENTION

1. Field of the Invention

The present invention relates to an endless-belt type walking presser foot for use in a sewing machine, and more particularly to an endless-belt type walking presser foot on which an attachment is installed to carry out superimposed seaming such as rolled hemming or tape seaming.

2. Prior Art

In a conventional endless-belt type walking presser foot of this kind, endless belts are constructed so as to be in tight contact with a frame constituting the endless-belt type walking presser foot instead of projecting upward from the frame, in order to prevent the projecting endless belts from obstructing a superimposed seaming operation, as described in Japanese Laid-Open Patent Publication (Kokai) No. 8-155168.

In the conventional endless-belt type walking presser foot, however, a large frictional resistance may occur between a bottom surface of the frame and inner peripheral portions of the endless belts to hinder the endless belts from smoothly rotating, thereby causing slippage of cloth during superimposed seaming. In such a case, the walking presser foot cannot provide its proper functions.

In addition, an attachment for installment on the walking presser foot has been known, for example, from Laid-Open Japanese Utility Model Publication (Kokai) No. 1-111577.

SUMMARY OF THE INVENTION

It is an object of the present invention to provide an endless-belt type walking presser foot which is capable of preventing slippage of cloth during superimposed seaming.

In order to attain the above object, the present invention provides an endless belt-type walking presser foot including a frame member having a pair of first endless belt guide grooves formed in a bottom surface thereof at locations near lateral side edges of the bottom surface and extending in a longitudinal direction of the presser foot, a pair of roller supports provided in front and rear portions of the frame member, a plurality of rollers each being journaled to a corresponding one of the roller supports and each having a second endless-belt guide groove in a form of an annulus formed therein, and a pair of endless belts each having a train of guide projections formed on an inner peripheral surface thereof and fitted in a corresponding one of the first endless belt guide grooves and a corresponding one of the second endless belt guide grooves, and a train of cloth slippage preventing projections formed on an outer peripheral surface thereof.

The endless belt-type walking presser foot according to the present invention is characterized in that the inner peripheral surface of each of the endless belts has a train of small projections, which are preferably semicylindrical, formed thereon which are configured so as to be in point or line contact with the bottom surface of the frame member and the roller.

With the above construction, the train of small projections, which are preferably semicylindrical, formed thereon the inner peripheral surface of each of the endless belts which are configured so as to be in point or line contact with the bottom surface of the frame member and the roller serve to facilitate the rotation of the roller, by increasing a gripping force effected between the endless belt and the roller, for example. As a result, the endless belt can smoothly rotate to prevent slippage of cloth during superimposed seaming.

Preferably, the endless-belt type walking presser foot according to the present invention includes at least one member, preferably formed of a fluorine-based resin, embedded in the bottom surface of the frame member for contact with the inner peripheral surface of each of the endless belts, the at least one member being lower in frictional resistance than a material forming the frame member.

According to this configuration, the at least one member embedded in the bottom surface of the frame member serves to reduce a frictional force effected between the bottom surface of the frame member and the inner peripheral surface of the endless belt to allow the endless belt to smoothly rotate, thereby preventing slippage of cloth during superimposed seaming.

Also preferably, the endless-belt type walking presser foot according to the present invention includes at least one member, preferably formed of a fluorine-based resin, embedded in the bottom surface of the frame member for contact with the cloth, the at least one member being lower in frictional resistance than a material forming the frame member.

According to this configuration, the at least one member embedded in the bottom surface of the frame member serves to reduce a frictional force effected between the bottom surface portion of the frame and the cloth to allow the endless belt to smoothly rotate, thereby preventing slippage of cloth during superimposed seaming.

Further preferably, the endless-belt type walking presser foot according to the present invention includes attachment mounting means for replaceably mounting various attachments for superimposed seaming and each having a superimposed seaming cloth guide portion in a manner such that the superimposed seaming cloth guide portion is located in front of the endless-belt type walking presser foot.

According to this configuration, the attachment mounting means can prevent the cloth from being opened during transfer thereof to a needle location, while preventing slippage of the cloth during superimposed seaming.

The above and other objects, features, and advantages of the invention will become more apparent from the following detailed description taken in conjunction with the accompanying drawings.

DETAILED DESCRIPTION

The present invention will be described below with reference to the drawings showing a preferred embodiment thereof.

Figure 1:
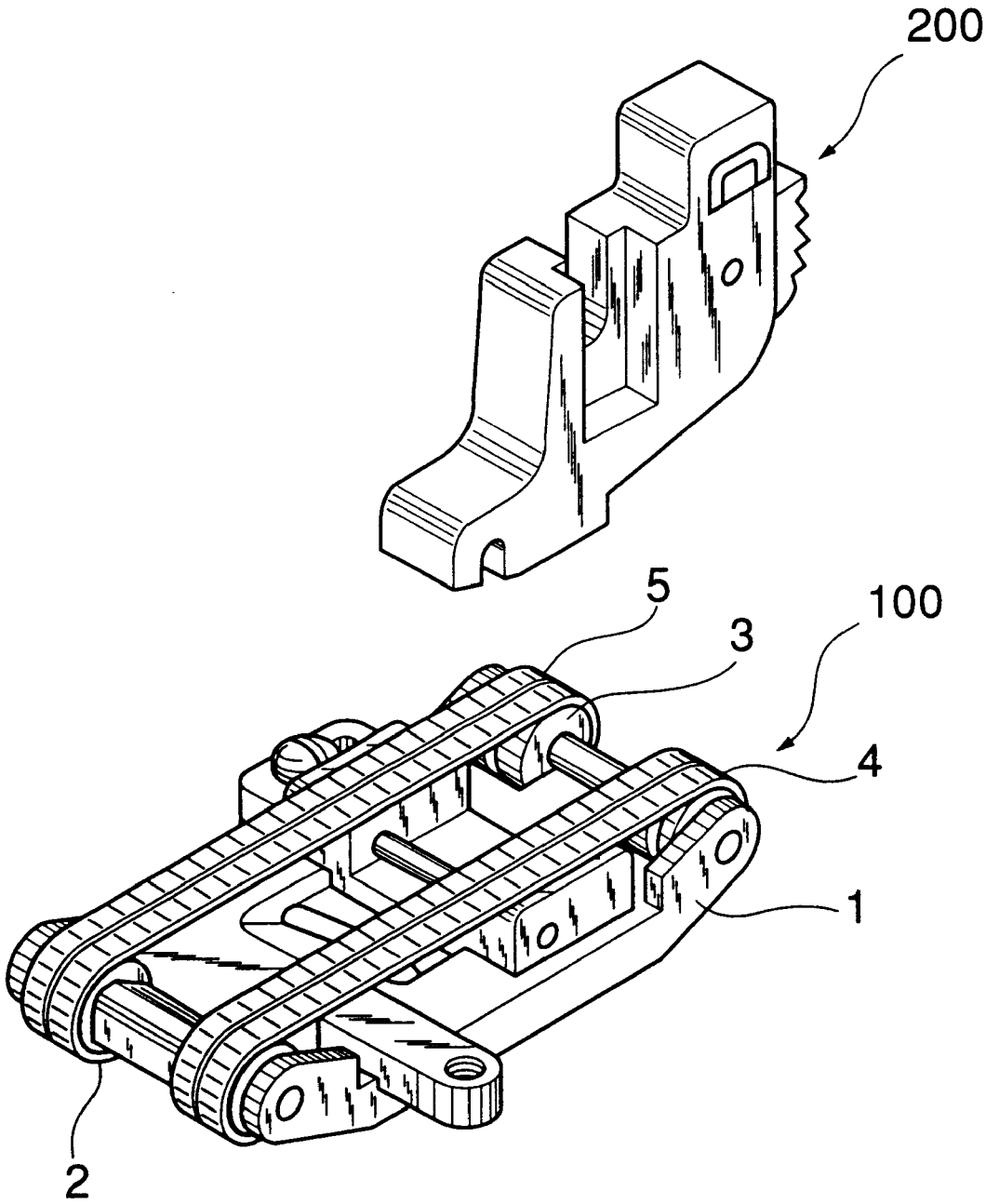
FIG. 1 is a perspective view of an endless-belt type walking presser foot according to an embodiment of the present invention.
Figure 2:
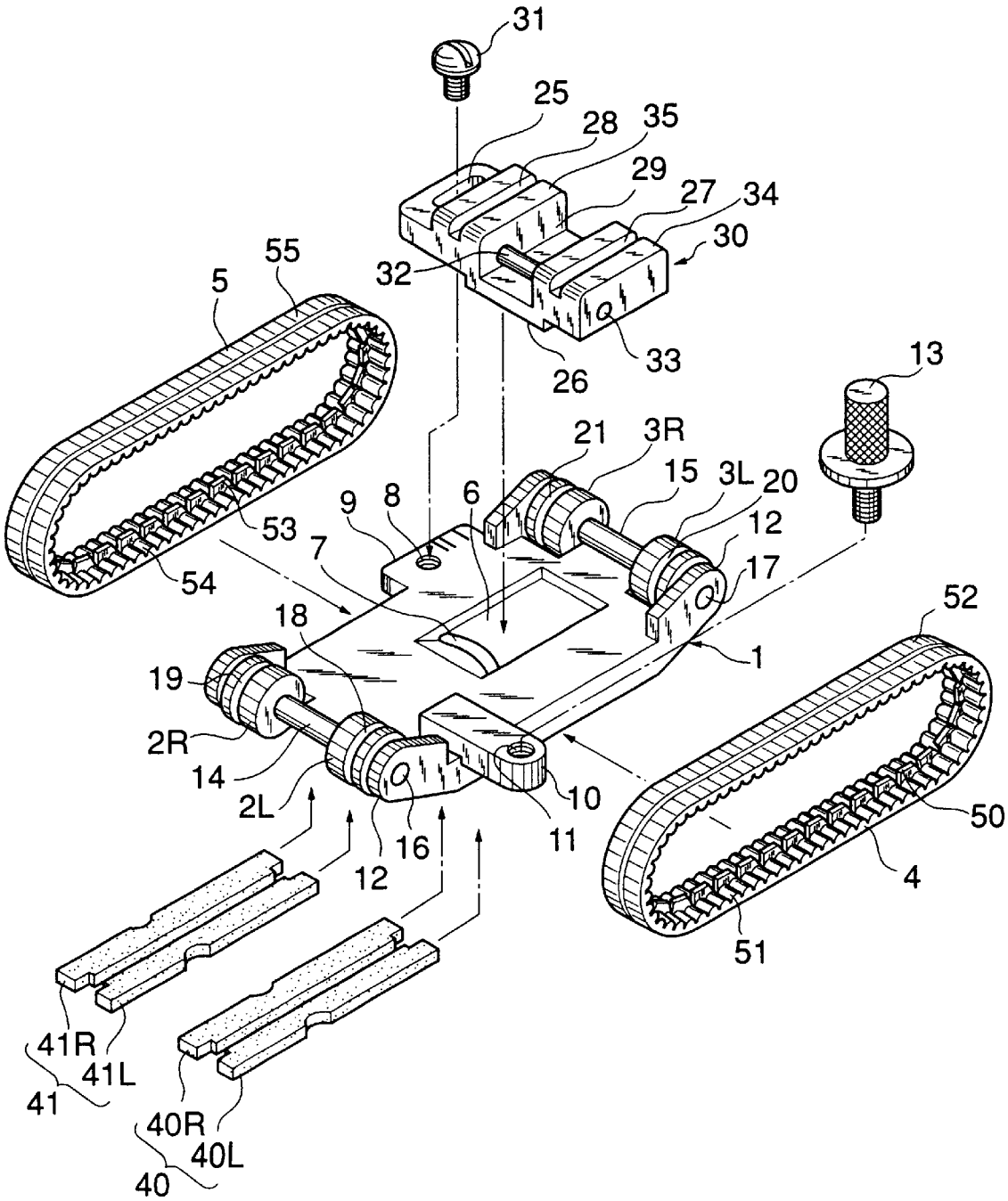
FIG. 2 is an exploded perspective view of the endless-belt type walking presser foot.
Figure 3:
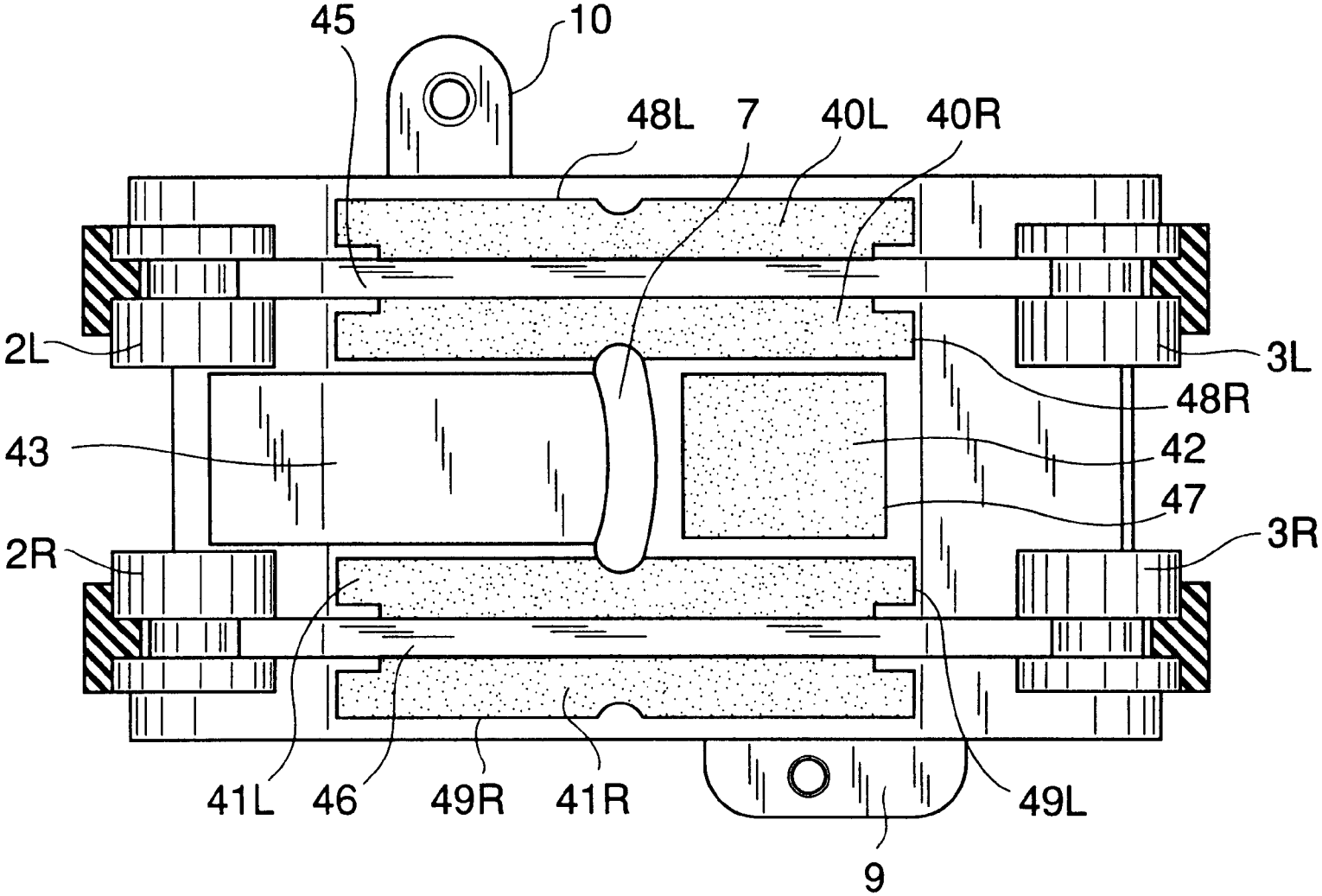
FIG. 3 is a bottom view of the endless-belt type walking presser foot.

FIG. 1 is a perspective view of an endless-belt type walking presser foot 100 according to an embodiment of the present invention. FIG. 2 is an exploded perspective view of the endless-belt type walking presser foot 100. FIG. 3 is a bottom view of the same.

As shown in FIG. 1, the endless-belt type walking presser foot 100 is principally comprised of a presser frame 1, a front roller 2, a rear roller 3, a left-hand endless belt 4, and a right-hand endless belt 5.

As shown in FIG. 2, the presser frame 1 is comprised of a recess 6 formed in a central portion of its top surface for mounting a presser holder mounting member 30, a needle location hole 7 located in front of the recess 6, and a pair of roller supports 12 upwardly obliquely projected at four corners.

In addition, a mounting portion 9 is provided at a right side edge of the presser frame 1, for mounting the presser holder mounting member 30. The mounting portion 9 has a tapped hole 8 into which a screw 31 is threadedly fitted to lock the press holder mounting member 30 in place. On the other hand, a mounting portion 10 is provided at a left side edge of the presser frame 1, for mounting a superimposed seaming attachment 80 or a tape seaming attachment 90, which will be described below. The mounting portion 10 has a tapped hole 11 into which a screw 13 is threadedly fitted to lock the attachment 80 or 90 in place.

The roller support 12 on the front side has formed therein a pair of front pin holes 16 in which opposite ends of a transversely extending front shaft pin 14 are securedly fitted so that the front roller 2 is journaled to the front shaft pin 14, while the roller support 12 on the rear side has formed therein a pair of rear pin holes 17 in which opposite ends of a transversely extending rear shaft pin 15 are securedly fitted so that the rear roller 3 is journaled to the rear shaft pin 15.

In addition, as shown in FIG. 3, a left-hand endless belt guide groove 45 and a right-hand endless belt guide groove 46 are formed in a bottom surface of the presser frame 1 and extend in a longitudinal direction of the presser foot 100. A recess 43 is formed in the bottom surface at a forward and transversely central portion thereof to reduce frictional resistance between the bottom surface and the cloth. A recess 47 is formed in the bottom surface at a rearward and transversely central portion thereof, in which a fluorine-based resin piece 42 formed of tetrafluoroethylene or the like is embedded.

Recesses 48L, 48R with fluorine-based resin pieces 40L, 40R formed of tetrafluoroethylene or the like embedded therein are provided in the bottom surface of the presser frame 1 at opposite lateral sides of the left-hand endless belt guide groove 45, and recesses 49L, 49R with fluorine-based resin pieces 41L, 41R formed of tetrafluoroethylene or the like embedded therein are provided in the bottom surface of the presser frame 1 at opposite lateral sides of the right-hand endless belt guide groove 46.

Referring again to FIG. 2, the front roller 2 is comprised of a front left roller 2L having a guide groove 18 in the form of an annulus formed therein on an extension of the left-hand endless belt guide groove 45, and a front right roller 2R having a guide groove 19 in the form of an annulus formed therein on an extension of the right-hand endless belt guide groove 46. The front roller 2 is journaled to the front-side roller support 12 via the front shaft pin 14.

On the other hand, the rear roller 3 is comprised of a rear left roller 3L having a guide groove 20 in the form of an annulus formed therein on an extension of the left-hand endless belt guide groove 45, and a rear right roller 3R having a guide groove 21 in the form of an annulus formed therein on an extension of the right-hand endless belt guide groove 46. The front roller 3 is journaled to the rear-side roller support 12 via the rear shaft pin 15.

The presser holder attachment member 30 is comprised of a left support shoulder 34 and a right support shoulder 35 both having support holes 33 formed therethrough in alignment to support a shaft pin 3. The left support shoulder 34 has a left-hand endless belt guide groove 27 extending in a longitudinal direction, while the right support shoulder 35 has a right-hand endless belt guide groove 28 extending in the longitudinal direction. A recess 29 is provided between the left support shoulder 34 and the right support shoulder 35, for receiving a snap holder 200 (FIG. 1) so that the snap holder 200 is fitted in the recess 29, and a bottom surface of the presser holder mounting member 30 has a projection 26 fitted in the recess 6. Further, the presser holder mounting member 30 has an elongate slot 25 penetrated by a screw 31 that is screwed in the tapped hole 8.

Figure 4:
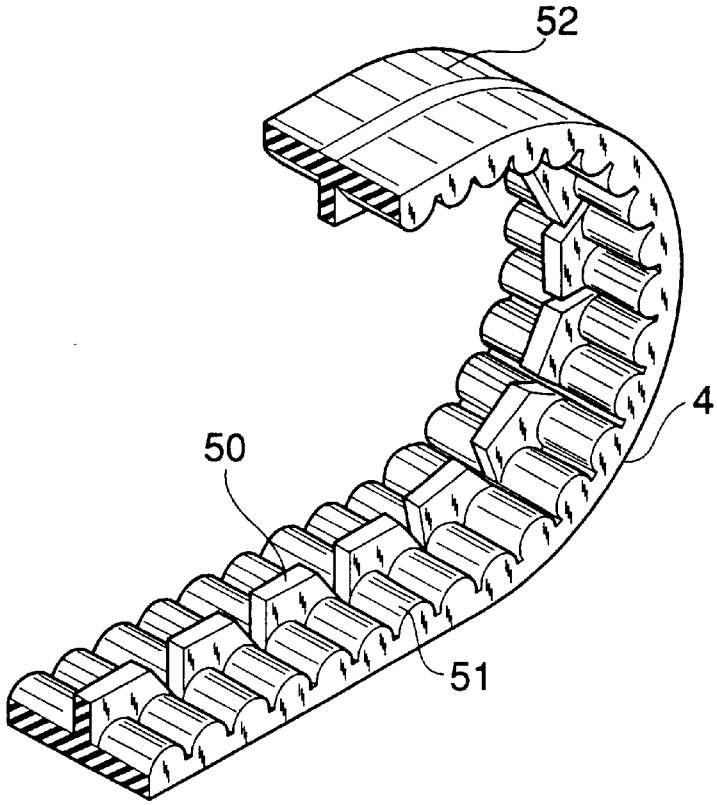
FIG. 4 is an enlarged fragmentary perspective view of a fragment of an endless belt of the endless-belt type walking presser foot.

FIG. 4 is an enlarged fragmentary perspective view of the left-hand endless belt 4. The left-hand endless belt 4 has its inner peripheral surface formed with a train of projections 50 for prevention of skid or transverse slippage that are fitted in the left-hand endless belt guide grooves 27, 45 and the guide grooves 18, 20, and also formed with a pair of trains of semicylindrical projections 51 provided at opposite lateral sides of the train of projections 50 in a fashion sandwiching the train 50 therebetween. The trains of semicylindrical projections 51 are smaller in height and width than the train of projections 50 and are arranged at a smaller pitch than the train 50. The trains of semicylindrical projections 51 are in line-contact with the fluorine-based resin pieces 40L, 40R.

Further, the left-hand endless belt 4 has a train of anti-cloth slippage projections 52 formed on its outer peripheral surface, and is wound around the bottom surface of the presser frame 1, the left support shoulder 34, the front left roller 2L, and the rear left roller 3L in the longitudinal direction. Likewise, the right-hand endless belt 5 has a train of skid or transverse slippage-preventing projections 53 and a train of semicylindrical projections 54 formed on its inner peripheral surface and anti-cloth-slipping projections 55 on its outer peripheral surface, and is wound around the bottom surface of the presser frame 1, the right support shoulder 35, the front right roller 2R, and the rear right roller 3R in a longitudinal direction. Similarly, the right-hand endless belt 5 has its inner peripheral surface formed with a train of projections 53 for prevention of skid or transverse slippage and a pair of trains of semicylindrical projections 54, and its outer peripheral surface formed with a train of anti-cloth slippage projections 55. The shape of the trains of semicylindrical projections 51, 54 is not limited to the one described above, but the semicylindrical projections 51, 54 may be shaped like semispheres so as to be in point-contact with the fluorine-based resin pieces 40, 41 or may have a triangular cross section so as to be in line-contact with the fluorine-based resin pieces 40, 41.

Various attachments for respective types of superimposed seaming can be installed on a front portion of the endless-belt type walking presser foot 100.

Figure 5:
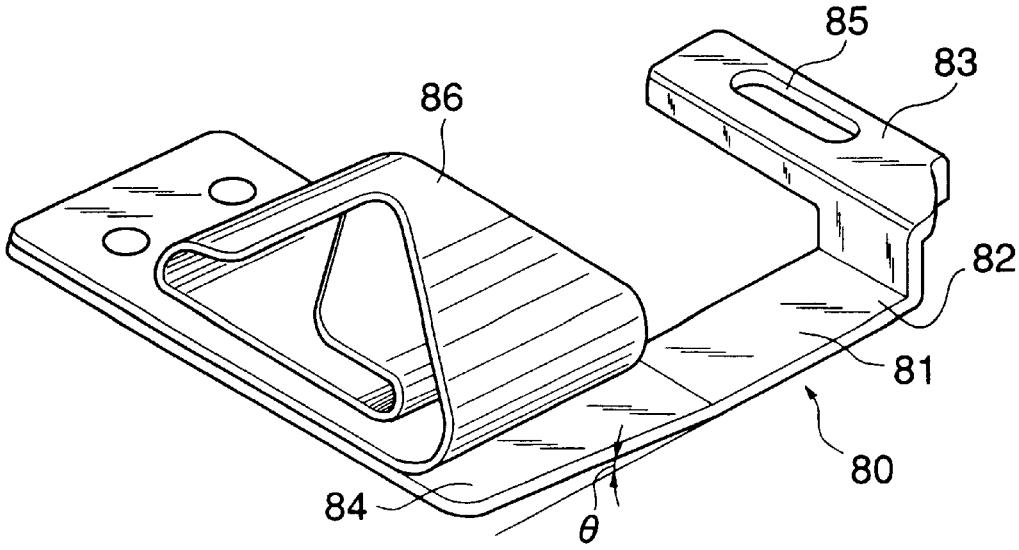
FIG. 5 is a perspective view of a superimposed seaming attachment to be installed on the endless-belt type walking presser foot.

FIG. 5 shows an example of such an attachment for superimposed seaming. The superimposed seaming attachment 80 is used for rolled hemming and comprised of a generally U-shaped frame 81, and a rolled-hemming cloth guide portion 86. The frame 81 is comprised of an arm 82 having a mounting portion 83 raised from one end of the arm 82 like a shoulder and having an elongate slot 85 formed therein and penetrated by the screw 13, and a guide portion 84 provided at the other end of the arm 82 and bent upward relative to the arm 82 through a very small angle θ, the guide portion 84 having a rolled-hemming cloth guide portion 86 fixed on its top surface.

Figure 6:
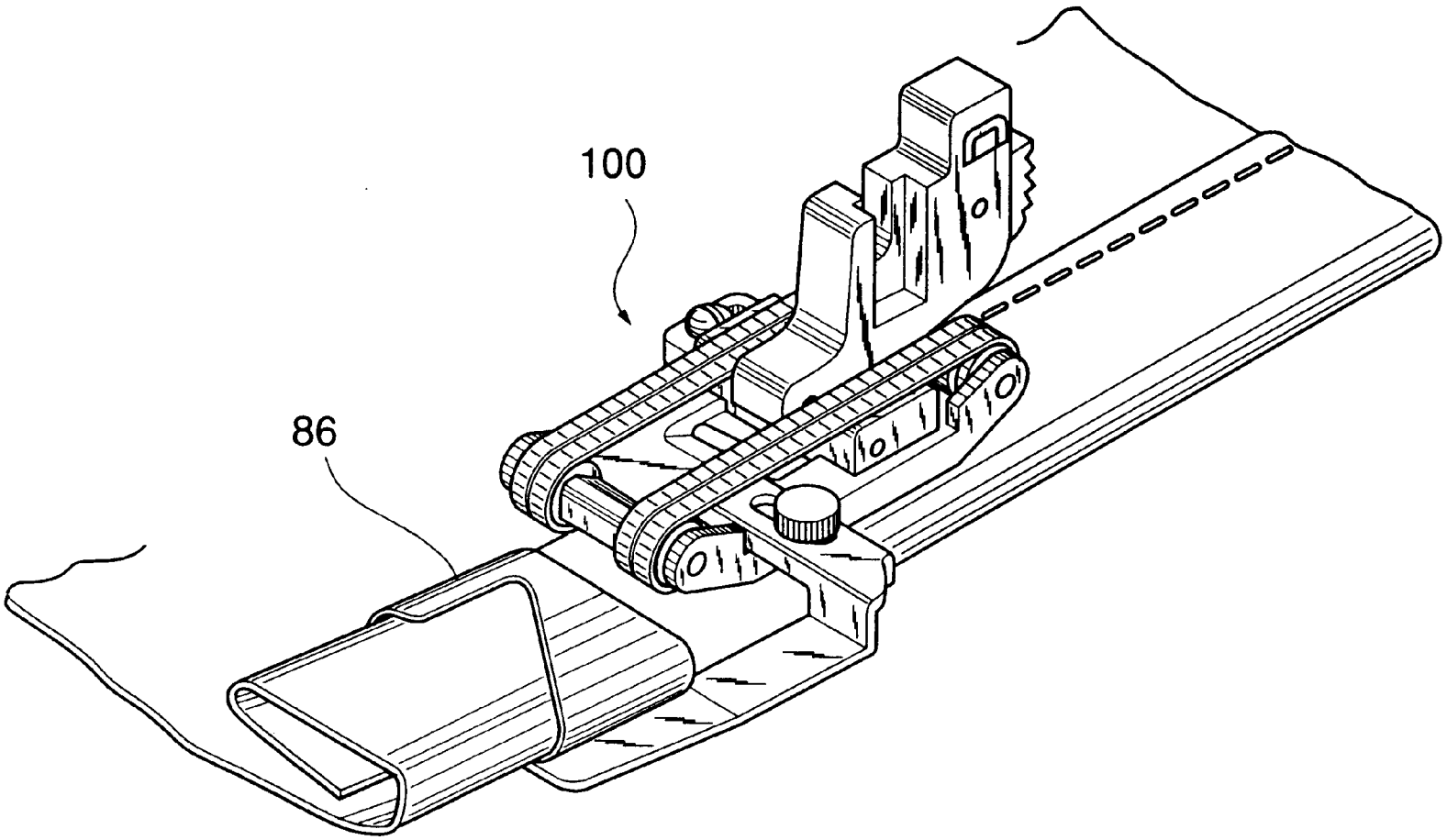
FIG. 6 shows how superimposed portions of a cloth to be rolled-hemmed are stitched.

The elongate slot 85 extends in a transverse direction of the presser foot 100 to enable the amount of transverse movement of the rolled-hemming cloth guide portion 86 to be adjusted. The reason why the guide portion 84 is bent upward through the very small angle θ is that a rolled-hemming cloth rolled through the rolled-hemming cloth guide portion 86 can be slipped under the endless-belt type walking presser foot 100, as shown in FIG. 6.

Figure 7C:
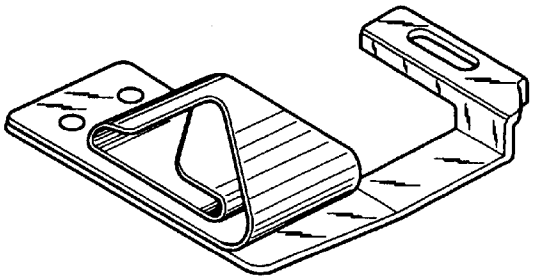
FIG. 7C is a perspective view of an attachment for rolled hemming with the largest width.
Figure 7B:
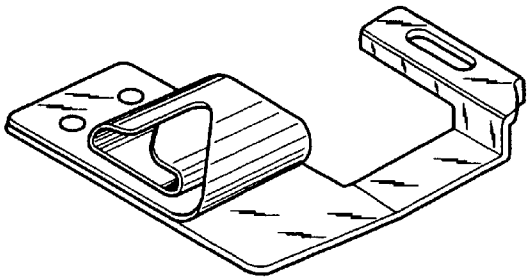
FIG. 7B is a perspective view of an attachment for rolled hemming with the second smallest width.
Figure 7A:
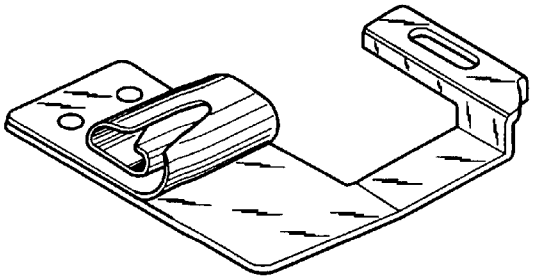
FIG. 7A is a perspective view of an attachment for rolled hemming with the smallest width.
Figure 8:
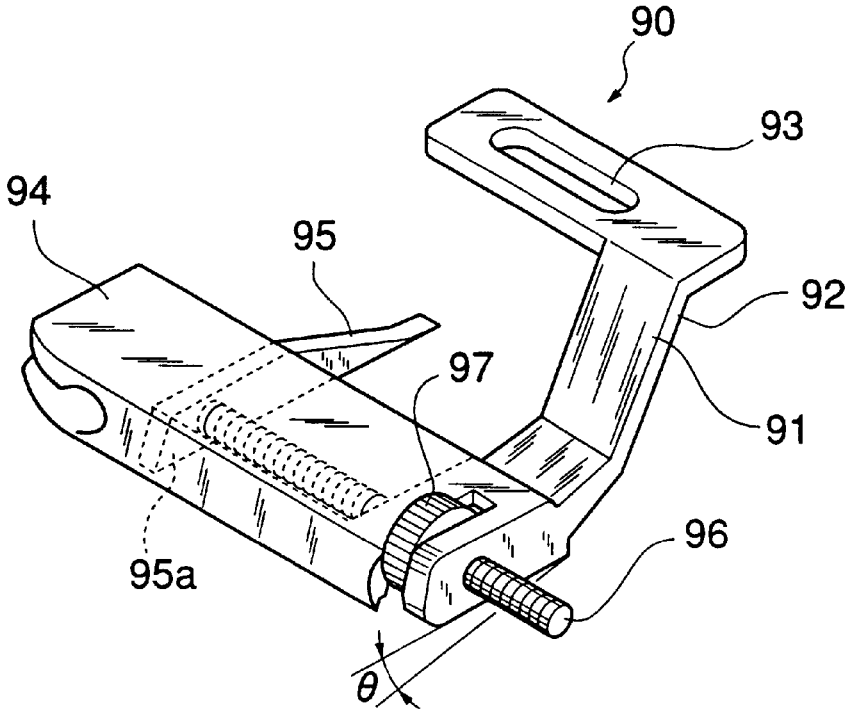
FIG. 8 is a perspective view of an attachment for tape seaming.

The superimposed seaming attachment 80 can be replaced, by removing the screw 13, with different attachments for respective predetermined widths of rolled-hemming clothes such as ones shown in FIGS. 7A to 7C, for example, or an attachment for tape seaming such as one shown in FIG. 8, for example. These attachments serve to prevent a rolled-hemming cloth from being opened during transfer thereof to a needle location and prevent the superimposed portions of the cloth from being misaligned.

FIG. 8 shows a superimposed seaming attachment 90 for tape seaming. The attachment 90 is comprised of a generally U-shaped frame 91 having an arm 92 at one end thereof, which has an elongate slot 93 formed therein and penetrated by the screw 13, and a tape holder 94 provided at the other end of the arm 92. The tape holder 94 has a tape guide 95 movably installed inside, which has a moving plate 95*a* at one side thereof to adjust the tape seaming width. A threaded rod 96 is coupled to the moving plate 95*a* for moving the tape guide 95. The threaded rod 96 rotatively advances and recedes as a nut 97 is rotated.

Similarly to the attachment 80 in FIG. 5, the tape holder 94 is bent upward relative to the arm 92 through the very small angle θ so that a tape that has passed through the tape guide 95 can be slipped under the endless-belt type walking presser foot 100.

The structure of the tape holder 94 is not limited to the above-described one based on the tape guide method that adjusts the tape seaming width and that is used for both linear sewing and curved sewing, but of course the present invention may use structures based on the trumpet-shaped-rolling guide method or the straight-stitch-exclusive method.

Next, the operation of the endless-belt type walking presser foot 100 constructed as described above will be described.

Figure 9:
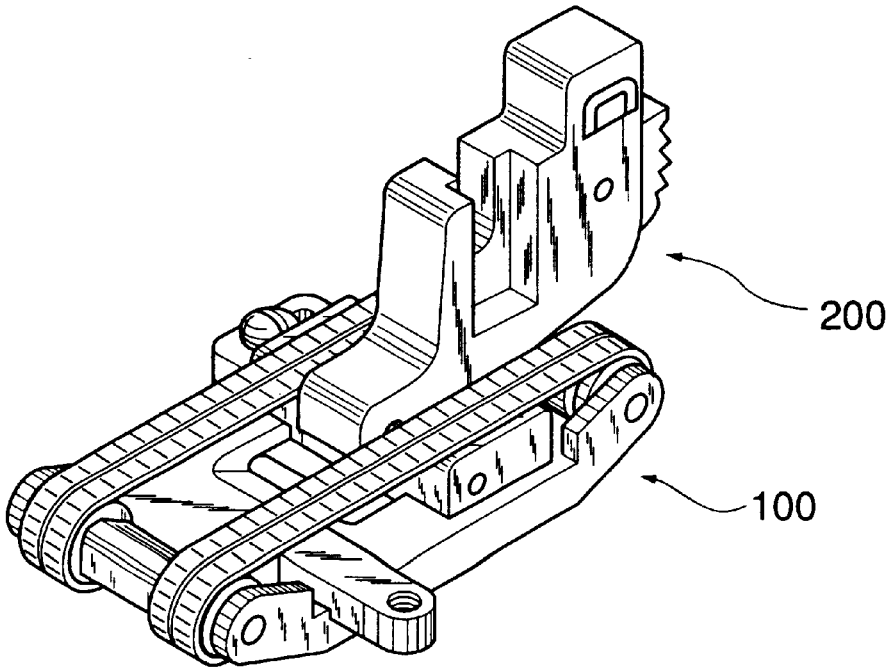
FIG. 9 is a perspective view of the endless-belt type walking presser foot according to the above embodiment set on a snap holder.

First, as shown in FIG. 9, the endless-belt type walking presser foot 100 is set on the snap holder 100, which is attached to a sewing machine darner rod (not shown).

Figure 10:
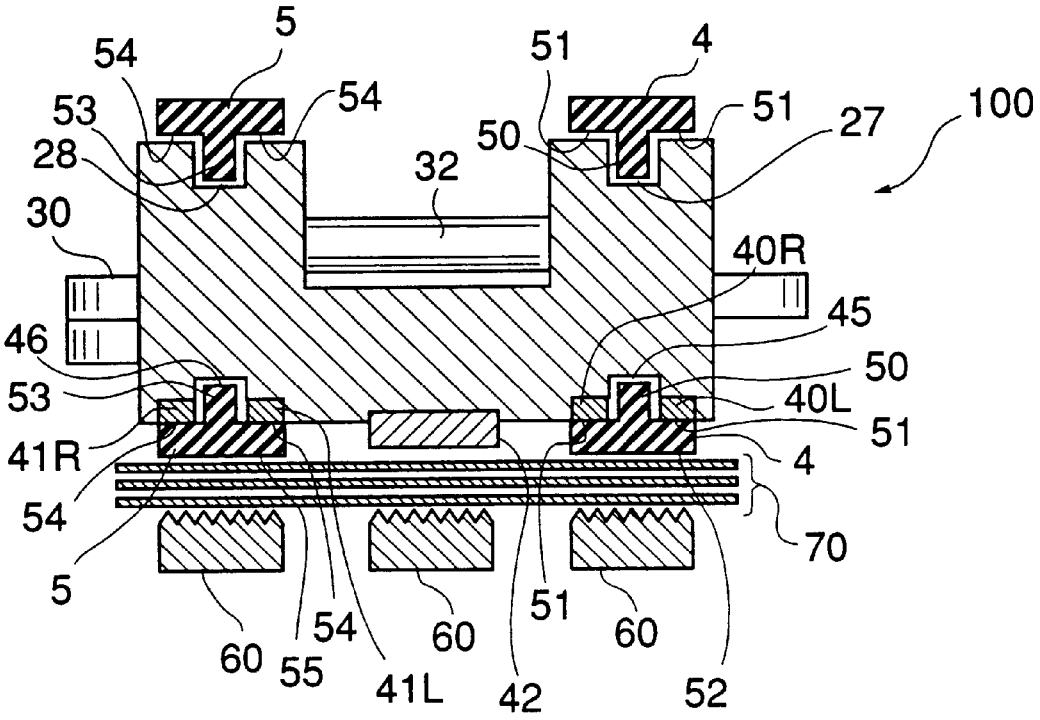
FIG. 10 is a sectional view of the endless-belt type walking presser foot according to the embodiment.

Then, as shown in FIG. 10, the sewing machine darner rod is lowered to allow the endless-belt type walking presser foot 100 to press a cloth 70 which is rolled in three plies. Then, the sewing machine is actuated, so that sewing machine feed dogs 60 reciprocatingly move in the longitudinal direction to apply a force to the three-ply rolled cloth 70 in a cloth feed direction. At this time, the anti-cloth-slippage projections 52, 55 on the outer peripheral surfaces of the endless belts 4, 5 prevent the rolled cloth 70 from slipping, thereby causing the endless belts 4, 5 to rotate in the cloth feed direction. In addition, at this time, the front roller 2 and the rear roller 3 allow the endless belts 4, 5 to rotate in a fashion being extended around the frame 1 in the form of an elongate ellipse in the longitudinal direction around the top and bottom surfaces of the presser frame 1. That is, the endless belts 4, 5 are prevented from projecting upward like annular rings and rotatively move in a flat form while being kept in tight sliding contact with the presser frame 1. The trains of skid-preventing projections 50, 53 on the inner peripheral surfaces of the endless belts 4, 5 are fitted in the endless belt guide grooves 27, 28, 45, and 46 and the guide grooves 18 to 21 during rotative movement of the endless belts 4, 5, thereby allowing the endless belts 4, 5 to rotate without skidding.

In addition, since the fluorine-based resin pieces 40L, 40R, 41L, and 41R are embedded in the bottom surface of the presser frame 1, the frictional resistance between the bottom surface of the presser frame 1 and the endless belts 4, 5 decreases to allow the endless belts 4, 5 to smoothly rotate in the cloth feed direction. Further, since the fluorine-based resin piece 42 is embedded in the rearward central portion of the bottom surface of the presser frame 1, the frictional resistance between the bottom surface of the presser frame 1 and the three-ply rolled cloth 70 decreases to allow the three-ply rolled cloth 70 to be smoothly fed in the cloth feed direction without being slipped for misalignment.

Furthermore, since the trains of semicylindrical projections 51, 54 are provided on the inner peripheral surfaces of the respective endless belts 4, 5 and the endless belts 4, 5 rotate in a fashion being extended around the frame 1, no slippage occurs between the rollers (the front roller 2 and the rear roller 3) and the belts (the endless belts 4, 5). That is, for example, the gripping force of the endless belts 4, 5 increases to allow the endless belts 4, 5 to smoothly rotate in the cloth feed direction. It has been ascertained that the provision of the trains of semicylindrical projections 51, 54 serves to prevent slippage of cloth during superimposed seaming in cooperation with the decrease in frictional resistance between the bottom surface of the presser frame 1 and the endless belts 4, 5.

As described above, according to this embodiment, the superimposed cloth such as the three-ply rolled cloth 70 can be prevented from being opened, etc. and the superimposed portions of the cloth can be prevented from being misaligned during transfer thereof to a needle location by the superimposed seaming attachment 80. In addition, the smooth rotation of the endless belts 4, 5 and the smooth feeding of the superimposed cloth allow the cloth to be smoothly transferred to the needle location while the cloth is maintained in the superimposed state, whereby superimposed seaming can be performed with the cloth maintained in the proper three-ply rolled state.

What is claimed is:

1. In an endless belt-type walking presser foot including a frame member having a pair of first endless belt guide grooves formed in a bottom surface thereof at locations near lateral side edges of the bottom surface and extending in a longitudinal direction of the presser foot, a pair of roller supports provided in front and rear portions of the frame member, a plurality of rollers each being journaled to a corresponding one of the roller supports and each having a second endless-belt guide groove in a form of an annulus formed therein, and a pair of endless belts each having a train of guide projections formed on an inner peripheral surface thereof and fitted in a corresponding one of said first endless belt guide grooves and a corresponding one of said second endless belt guide grooves, and a train of cloth slippage preventing projections formed on an outer peripheral surface thereof, the improvement wherein said inner peripheral surface of each of said endless belts has a train of small projections formed thereon which are configured so as to be in point or line contact with said bottom surface of said frame member and said roller.

2. An endless-belt type walking presser foot according to claim 1, wherein said train of small projections comprises semicylindrical projections.

3. An endless-belt type walking presser foot according to claim 1, including at least one member embedded in said bottom surface of said frame member for contact with the inner peripheral surface of each of said endless belts, said at least one member being lower in frictional resistance than a material forming said frame member.

4. An endless-belt type walking presser foot according to claim 1, including at least one member embedded in said bottom surface of said frame member for contact with said cloth, said at least one member being lower in frictional resistance than a material forming said frame member.

5. An endless-belt type walking presser foot according to claim 3, wherein said at least one member is formed of a fluorine-based resin.

6. An endless-belt type walking presser foot according to claim 4 wherein said at least one member is formed of a fluorine-based resin.

7. An endless-belt type walking presser foot according to claim 4, including attachment mounting means for replaceably mounting various attachments for superimposed seaming and each having a superimposed seaming cloth guide portion in a manner such that said superimposed seaming cloth guide portion is located in front of the endless-belt type walking presser foot.

* * * * *